US006408145B1

(12) United States Patent
Ohki

(10) Patent No.: US 6,408,145 B1
(45) Date of Patent: Jun. 18, 2002

(54) IMAGE FORMING APPARATUS INCLUDING CHARGER APPLIED WITH VOLTAGE CHANGED BETWEEN MONOCHROME MODE AND FULL-COLOR MODE

(75) Inventor: Makoto Ohki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/668,460

(22) Filed: Sep. 25, 2000

(30) Foreign Application Priority Data

Oct. 1, 1999 (JP) ..... 11-281243

(51) Int. Cl.[7] ..... G03G 15/02
(52) U.S. Cl. ..... 399/50; 399/176
(58) Field of Search ..... 399/50, 174–176; 361/225

(56) References Cited

U.S. PATENT DOCUMENTS 5,483,323 A * 1/1996 Matsuda et al. ..... 399/176 X
5,512,982 A * 4/1996 Takahashi et al. ..... 399/176
5,659,853 A * 8/1997 Matsuda et al. ..... 399/176
5,991,557 A * 11/1999 Kunishi et al. ..... 399/50 X

* cited by examiner

*Primary Examiner*—William J. Royer
(74) *Attorney, Agent, or Firm*—Fitzpatrick, Cella, Harper & Scinto

(57) ABSTRACT

An image forming apparatus has a monochrome mode for forming an image in a single color and a full-color mode for forming a full-color image in multiple colors. The image forming apparatus includes a photoconductor, a charging member contacting the photoconductor and charging the photoconductor with electricity, a power supply for applying, to the charging member, a DC voltage or a voltage including a DC voltage and an AC voltage in superimposed relation, and a unit for changing an AC component of the voltage applied to the charging member between the monochrome mode and the full-color mode.

5 Claims, 6 Drawing Sheets

Y : YELLOW TONER IMAGE
M : MAGENTA TONER IMAGE
C : CYAN TONER IMAGE
Bk : BLACK TONER IMAGE

FULL-COLOR IMAGE FORMING MODE,
AC CHARGING

BLACK UNICOLOR IMAGE FORMING MODE, DC CHARGING

BLACK UNICOLOR IMAGE FORMING MODE, AC CHARGING

IMAGE FORMING APPARATUS INCLUDING CHARGER APPLIED WITH VOLTAGE CHANGED BETWEEN MONOCHROME MODE AND FULL-COLOR MODE

BACKGROUND OF THE INVENTION

1. Field of the Invention

The present invention relates to an image forming apparatus such as a copying machine and a printer utilizing the electrophotographic process or the electrostatic recording process, and more particularly to an image forming apparatus capable of forming an image in a monochrome mode and a full-color mode.

2. Description of the Related Art

A multicolor electrophotographic copying machine for forming a full-color image with the electrophotographic process will be described below by way of example.

In the multicolor electrophotographic copying machine, a series of toner image forming processes, i.e., charging, exposing and developing processes, are carried out on a photoconductive drum serving as an image carrier to form toner images of four colors, i.e., a yellow toner image, a cyan toner image, a magenta toner image and a black toner image, which are color-separated toner images of a full-color image. Those toner images are transferred onto the same recording medium in superimposed relation and then fused under heating for permanent fixation, whereby the full-color image is formed by mixing of the four colors.

As a means for charging the photoconductive drum, a contact charging device is used because of such advantages that it is of the low-voltage type and generates less ozone.

The contact charging device comprises an electrically conductive member (contact charging member) in the form of a roller, for example, which is disposed in contact with the photoconductive drum. A charging bias is then applied to the contact charging member, whereby the surface of the photoconductive drum is charged to have a predetermined polarity and potential.

Contact charging is divided into a DC charging method in which the surface of the photoconductive drum is charged by applying, as the charging bias, only a DC voltage to the contact charging member, and an AC charging method in which the surface of the photoconductive drum is charged by applying an AC voltage component and a DC voltage component to the contact charging member. The AC charging method is superior to the DC charging method in stability against environmental changes and uniformity of charging.

The multicolor electrophotographic copying machine described above forms a full-color image by reproducing a full color by combinations of four-color toner images, i.e., a yellow toner image, a cyan toner image, a magenta toner image and a black toner image. Accordingly, if uniformity of a surface potential of the photoconductive drum is deteriorated due to, e.g., variations in charging, an image failure such as unevenness in image color would occur.

Because the DC charging method has a difficulty in keeping uniformity of charging, the AC charging method is essential and used to perform the contact charging of the photoconductive drum in the multicolor electrophotographic copying machine described above.

The multicolor electrophotographic copying machine having the above-described construction operates in a very satisfactory manner, but has the following problems.

An AC component applied for the contact charging in the AC charging method tends to destroy the bridges of a high-molecular material, e.g., polycarbonate, which forms the surface of the photoconductive drum, and therefore the photoconductive drum surface is likely to become brittle. As shown in FIG. 8, therefore, the AC charging method causes an abrasion of a surface layer of the photoconductive drum per rotation of the drum 2 to 3 times as large as that with the DC charging method.

Thus, looking at the photoconductive drum from the viewpoint of useful life, the AC charging method is one factor which shortens the useful life of the photoconductive drum.

Meanwhile, with widespread color copying or printing of business documents, etc., color copying machines and color printers have been recently employed in offices and the likes. Because installing both a full-color copying machine or printer and a monochrome copying machine or printer is disadvantageous from the cost point of view, a full-color copying machine or printer is equipped to be also used as a monochrome copying machine or printer in many cases.

In such a case, a usage rate of monochrome output is usually higher than that of full-color output. It is estimated that the usage rate of monochrome output is 60% at minimum and approximately 95% at maximum.

Under the above situation, the running cost during the monochrome output operation is very important. A rate of the cost of the photoconductive drum in the total running cost is great. In other words, a reduction in useful life of the photoconductive drum resulted from employing the AC charging method increases the running cost during the monochrome output operation.

SUMMARY OF THE INVENTION

Accordingly, it is an object of the present invention to provide an image forming apparatus which can produce a full-color image with high quality.

Another object of the present invention is to provide an image forming apparatus in which an image carrier has a longer useful life.

Still another object of the present invention is to provide an image forming apparatus which includes an image carrier for carrying an electrostatic latent image, a charging member contacting the image carrier and charging to the image carrier with electricity, a voltage applying unit for applying a voltage to the charging member, a selecting unit for selecting one of a monochrome mode for forming an image in a single color and a full-color mode for forming an image in multiple colors, and a changing unit for changing a voltage applied from the voltage applying unit to the charging member between the monochrome mode and the full-color mode.

Further objects, features and advantages of the present invention will become apparent from the following description of the preferred embodiments with reference to the attached drawings.

DESCRIPTION OF THE PREFERRED EMBODIMENTS

<First Embodiment> (FIGS. 1 to 5)

Figure 1:
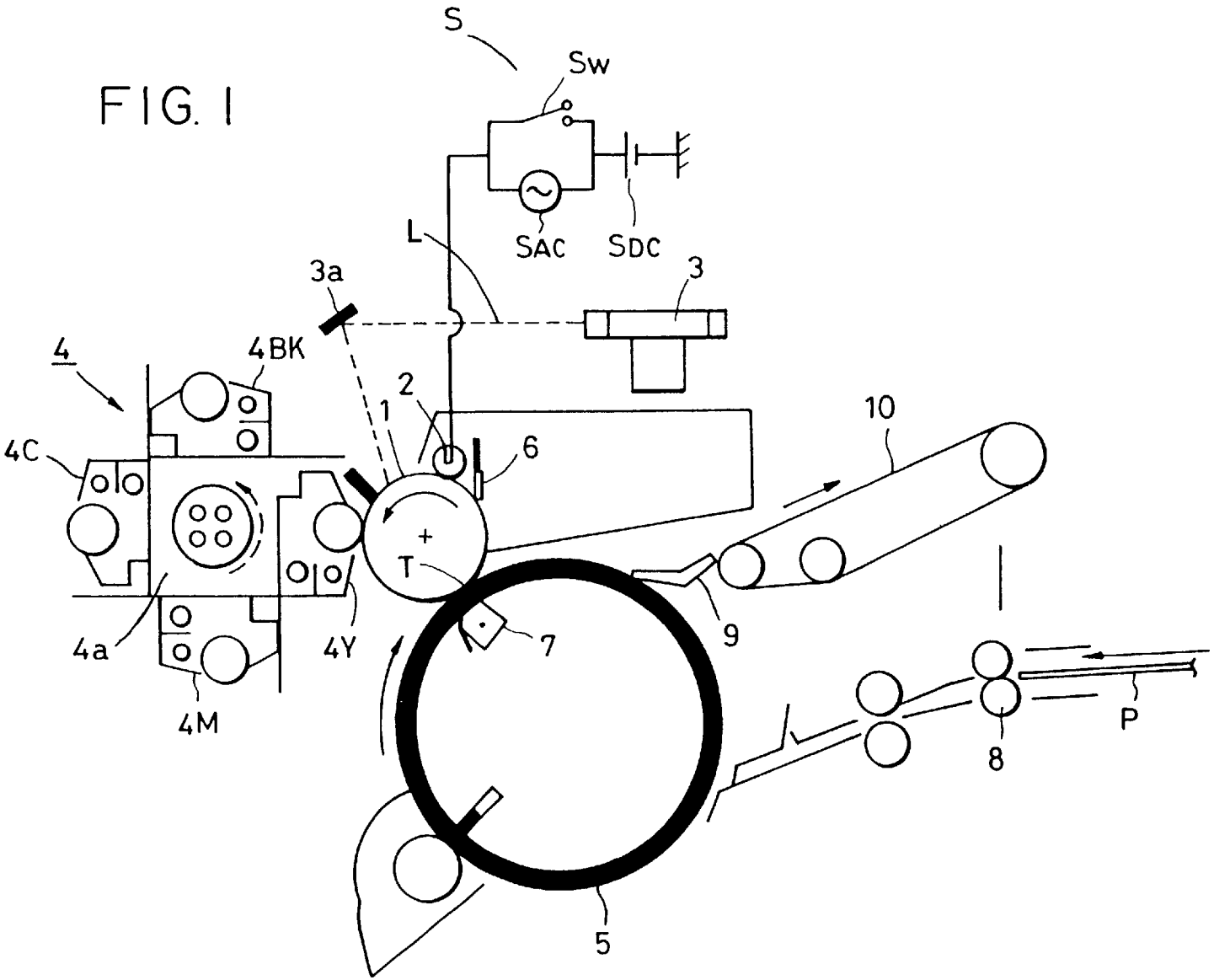
FIG. 1 is a schematic view showing the construction of an image forming apparatus according to a first embodiment.

FIG. 1 schematically shows the construction of an image forming apparatus according to a first embodiment. The image forming apparatus of this embodiment is a multicolor electrophotographic copying machine.

(1) Outline of Overall Apparatus Construction

Numeral 1 denotes a photoconductive drum which serves as an image carrier and which is supported in a rotatable manner. The photoconductive drum 1 is driven to rotate counterclockwise as indicated by the arrow at a predetermined circumferential speed.

Numeral 2 denotes a charging roller (electrically conductive member in the form of a roller) which serves as a contact charging member and is disposed in contact with the photoconductive drum 1 under a predetermined pressing force. The charging roller 2 of this embodiment is a rubber- or sponge-made roller member fitted over an electrically conductive shaft and having an electrical resistance value adjusted to $10^6\Omega$. The charging roller 2 is rotated following rotation of the photoconductive drum 1. S denotes a power supply for applying a charging bias to the charging roller 2. A predetermined charging bias is applied from the power supply S to the shaft of the charging roller 2, whereby a circumferential surface of the rotating photoconductive drum is contact-charged to a predetermined polarity and potential.

The power supply S comprises a DC source $S_{DC}$ for generating a DC voltage, an AC source $S_{AC}$ for generating an AC voltage, and a switch $S_W$ for selecting whether the AC voltage is applied. Switching operation of the switch $S_W$ is controlled by a CPU (not shown).

Numeral 3 denotes a laser beam exposure device serving as an exposure means. A laser beam L emitted from the exposure device 3 and modulated in accordance with image information scans a charged surface area of the rotating photoconductive drum 1 for exposure. An electrostatic latent image is thereby formed corresponding to an optical image scanned for exposure. 3*a* denotes a mirror for deflecting the laser beam L emitted from the exposure device 3 to an exposure position on the rotating photoconductive drum 1.

Numeral 4 denotes a developing device for attaching a toner to the electrostatic latent image formed on the photoconductive drum 1 and developing it into a toner image. The developing device 4 of this embodiment is a color developing device of rotary changeover type. Four developing units, i.e., a yellow developing unit 4Y containing a yellow toner developer, a magenta developing unit 4M containing a magenta toner developer, a cyan developing unit 4C containing a cyan toner developer, and a black developing unit 4Bk containing a black toner developer, are held around a substantially cylindrical housing 4*a* supported in a rotatable manner with angular intervals of about 90°. Each time the housing 4*a* is rotated through 90°, the positions of the above four developing units are selectively changed over to locate at a predetermined development position facing the photoconductive drum 1.

Numeral 5 denotes a transfer drum. The transfer drum 5 is disposed adjacent to the photoconductive drum 1 and is driven to rotate clockwise as indicated by arrow at almost the same circumferential speed as the photoconductive drum 1. A transfer position T is provided at a point where the photoconductive drum 1 and the transfer drum 5 are opposed in close relation. The transfer drum 5 comprises a pair of cylinders disposed at both drum ends, and a transfer material bearing sheet which serves as a transfer material bearing member and is stretched to extend over the outer circumferential surfaces of the cylinders in vacant areas thereof. A transfer charger 7 serving as a transfer means is provided within the transfer drum 5 at a location corresponding to the transfer position T.

A transfer material (sheet of paper) P is supplied from a paper feed mechanism (not shown). When the transfer material P is fed to the transfer drum 5 at predetermined control timing through a sheet path including a register roller pair 8, the leading end of the transfer material P is gripped by a not-shown chuck (gripper) provided on the side of the transfer drum 5. As the transfer drum 5 rotates, the transfer material P is wound over a surface of the transfer material bearing sheet covering an outer circumferential surface of the transfer drum 5, and is electrostatically held thereon. The transfer material P wound over and held on the outer circumferential surface of the transfer drum 5 is rotated together with the transfer drum 5, and the toner image on the side of the rotating photoconductive drum 1 is transferred onto the transfer material P when it passes the transfer position T.

After being subjected to the transfer of the toner image, the leading end of the transfer material P held on the transfer drum 5 is released from the chuck, and the transfer material P is separated from the rotating transfer drum 5 by a separation claw member 9. Then, the transfer material P is fed by a transport device 10 to a fusing roller (not shown) where the toner image is fused under heating for permanent fixation. Thereafter, the transfer material P is ejected as an image formed material out of the machine.

After the toner image has been transferred from the photoconductive drum 1 onto the transfer material P, the toner remaining on the drum surface is removed by a cleaner 6 and the photoconductive drum 1 is brought into a next cycle of the image forming process again.

(2) Full-color Image Forming

When the full-color image forming mode is selected, the contact charging of the photoconductive drum 1 is carried out by the AC charging method to apply both an AC voltage component and a DC voltage component in superimposed relation for the purpose of increasing uniformity of the charging.

In this embodiment, after being contact-charged by the charging roller 2 using the AC charging method, the rotating photoconductive drum 1 is subjected to the following processes.

① The laser beam exposure device 3 exposes the drum surface with an optical image corresponding to a color-separated blue image of a color image, thereby forming an electrostatic latent image. The electrostatic latent image is developed into a yellow toner image by the yellow developing unit 4Y, and the yellow toner image is transferred at the transfer position T onto the surface of the transfer material P wound over and held on the transfer drum 5.

② The laser beam exposure device 3 exposes the drum surface with an optical image corresponding to a color-separated green image of the color image, thereby forming an electrostatic latent image. The electrostatic latent image is developed into a magenta toner image by the magenta developing unit 4M, and the magenta toner image is transferred at the transfer position T onto the surface of the transfer material P, which remains wound over and held on the transfer drum 5, so as to overlie and align with the yellow toner image having been already transferred.

③ The laser beam exposure device 3 exposes the drum surface with an optical image corresponding to a color-separated red image of the color image, thereby forming an electrostatic latent image. The electrostatic latent image is developed into a cyan toner image by the cyan developing unit 4C, and the cyan toner image is transferred at the transfer position T onto the surface of the transfer material P, which remains wound over and held on the transfer drum 5, so as to overlie and align with the yellow and magenta toner images having been already transferred.

④ The laser beam exposure device 3 exposes the drum surface with an optical image corresponding to a color-separated black image of the color image, thereby forming an electrostatic latent image. The electrostatic latent image is developed into a black toner image by the black developing unit 4Bk, and the black toner image is transferred at the transfer position T onto the surface of the transfer material P, which remains wound over and held on the transfer drum 5, so as to overlie and align with the yellow, magenta and cyan toner images having been already transferred.

By carrying out the above processes ① to ④ in order, the toner images of four colors, i.e., the yellow toner image, the magenta toner image, the cyan toner image and the black toner image, are successively transferred onto the surface of the same transfer material P in superimposed relation, which remains wound over and held on the transfer drum 5. After completion of the above processes, the leading end of the transfer material P is released from the chuck, and the transfer material P is separated from the rotating transfer drum 5 by the separation claw member 9. Then, the transfer material P is fed by the transport device to the fusing roller (not shown) where the toner image is fused under heating for permanent fixation. Thereafter, the transfer material P is ejected as a full-color image formed material out of the machine.

(3) Black Unicolor Image Forming

When the black unicolor image forming mode is selected, the contact charging of the photoconductive drum 1 is carried out by switching the charging method to the DC charging in which only a DC voltage is applied without applying an AC voltage. Also, the rotary developing device 4 is rotated to change over the developing unit such that the black developing unit 4Bk is located at the development position of the photoconductive drum 1.

The rotating photoconductive drum 1 is contact-charged by the charging roller 2 using the DC charging method, and then exposed by the laser beam exposure device 3 to an optical image corresponding to a black unicolor image, thereby forming an electrostatic latent image. The electrostatic latent image is developed into a black toner image by the black developing unit 4Bk, and the black toner image is transferred at the transfer position T onto the surface of the transfer material P which is wound over and held on the transfer drum 5. After completion of the above process, the leading end of the transfer material P is released from the chuck, and the transfer material P is separated from the rotating transfer drum 5 by the separation claw member 9. Then, the transfer material P is fed by the transport device 10 to the fusing roller (not shown) where the toner image is fused under heating for permanent fixation. Thereafter, the transfer material P is ejected as a black unicolor image formed material out of the machine.

(4) Changeover of Condition for Applying AC Component of Charging Bias

In this embodiment, as described above, the contact charging of the photoconductive drum 1 in the full-color image forming mode is carried out by the AC charging method to apply both an AC voltage component and a DC voltage component in superimposed relation for the purpose of increasing uniformity of the charging.

Figure 2:
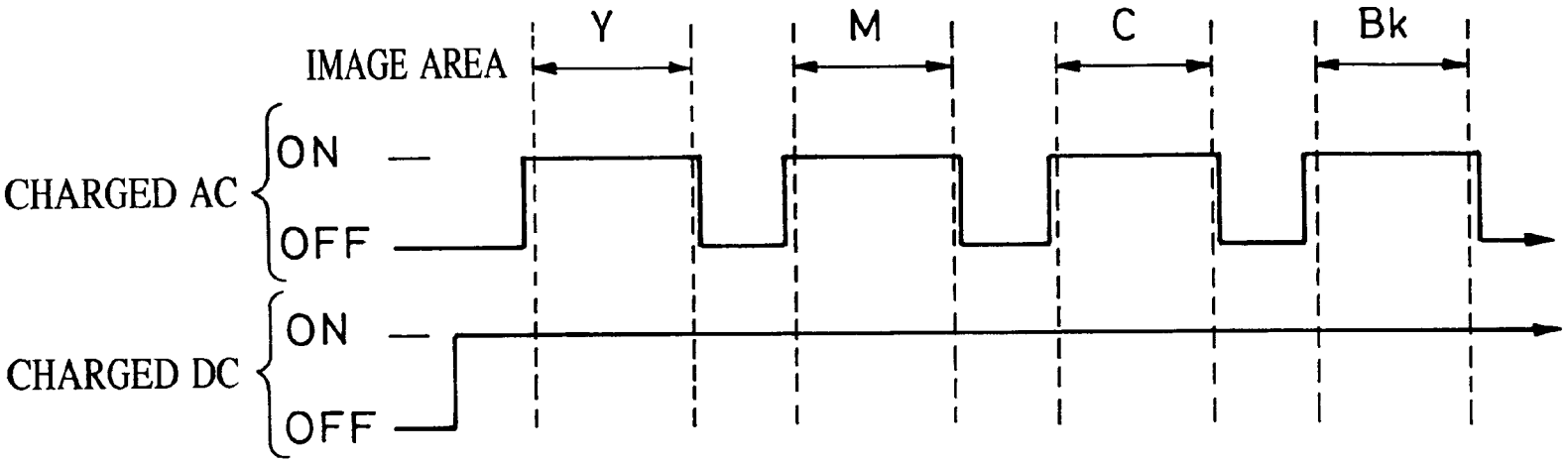
FIG. 2 is a time chart showing application of a charging bias (AC charging) in the full-color image forming mode.
Figure 3:
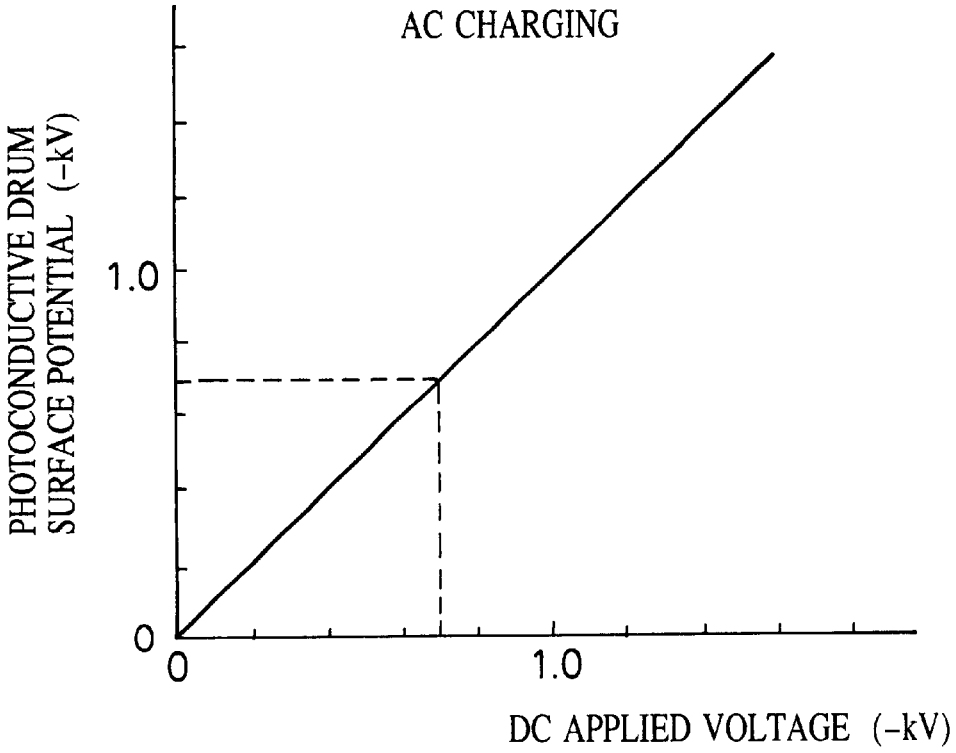
FIG. 3 is a graph showing a photoconductive drum surface potential with respect to an applied DC voltage during AC charging.
Figure 8:
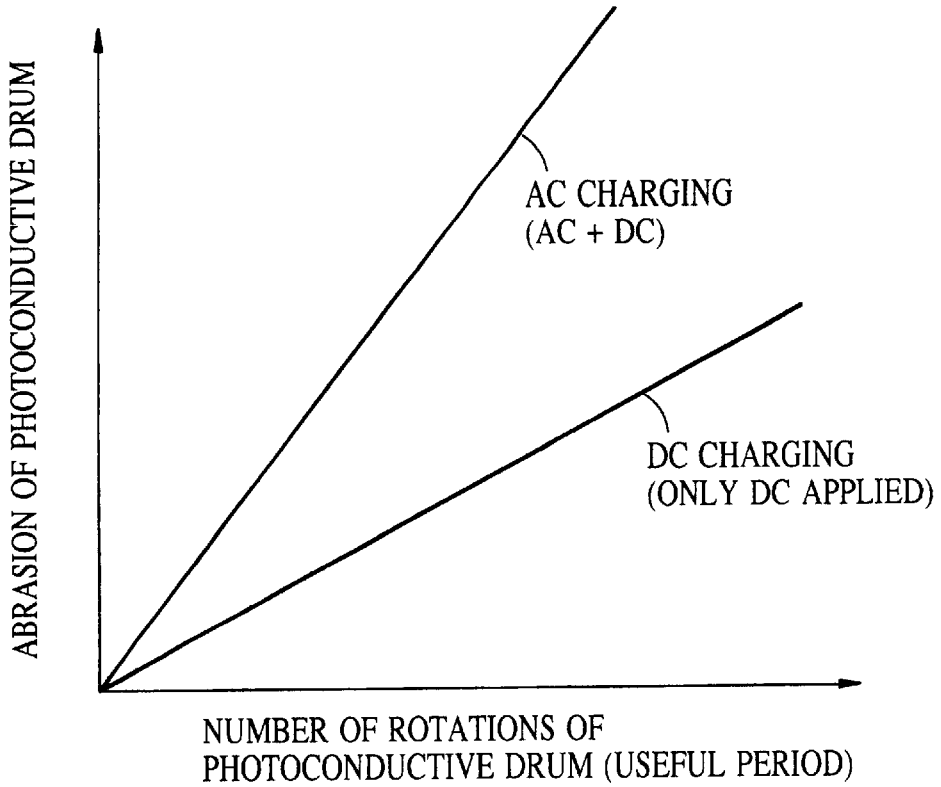
FIG. 8 is a graph showing an abrasion of a photoconductive drum.

As shown in FIG. 2, the AC component is applied corresponding to each image formed position (image area). The use of the AC charging method in the contact charging causes, as described above and as shown in FIG. 8, an abrasion of a surface layer of the photoconductive drum 2 to 3 times as large as that with the DC charging method. In view of that fact, the AC component is applied to only the image formed position, as shown in FIG. 2, for reducing an AC applying time to a least necessary value.

In this embodiment, the AC component is applied under constant-current control on condition that a control current value is 1750 $\mu$A and a frequency is 1150 Hz. The DC component is applied under constant-voltage control and has a control voltage value of—700 V.

Also, in this embodiment, a target value of the charged potential is set to one of charging target values, which are stored in the machine body, depending on temperature and humidity information detected by an environment sensor (not shown). The charging target values can be determined by any of various methods. According to one example, a test pattern is formed on the photoconductive drum and a target value is determined from density information of the formed pattern. A condition for applying a high charging voltage to achieve the charging target value depends on the DC component, and in the AC charging, it depends on a set value of the charged DC component. Specifically, when the target value of the charged potential is—700 V, for example, the surface of the photoconductive drum can be charged to the target value by applying the DC component under constant-voltage control at—700 V (see FIG. 3).

As described above, a full-color image is formed by using toners of four colors, i.e., yellow Y, magenta M, cyan C and black Bk, and controlling delicate density balance among the four colors. In the contact charging, applying the AC component is very effective to improve uniformity of the charging on the photoconductive drum. When no AC component is applied, slight unevenness in charging occurs on the surface of the photoconductive drum, thus giving rise to an image failure such as unevenness in image color when the four colors are superimposed with each other. For this reason, it is indispensable to apply the AC component in formation of a full-color image using the contact charging.

On the other hand, when the black unicolor image forming mode is selected, the contact charging of the photoconductive drum 1 is carried out by switching the charging method to the DC charging in which only a DC voltage is applied without applying an AC voltage.

More specifically, a uniformity level of the charging required in the case of forming an image of single color, e.g., black, is lower than in the case of forming a full-color image. In the full-color mode, as described above, variations in surface potential of the photoconductive drum over an area corresponding to one piece of image tend to appear in a resulting image unless those variations are, though depending on the cycle, less than 10 V. In the black unicolor mode, however, image quality is hardly deteriorated if those variations are within 20 V. Furthermore, on an assumption that an image is a line drawing such as letters, there occur no problems in practical use if those variations are within 30 V.

Figure 4:
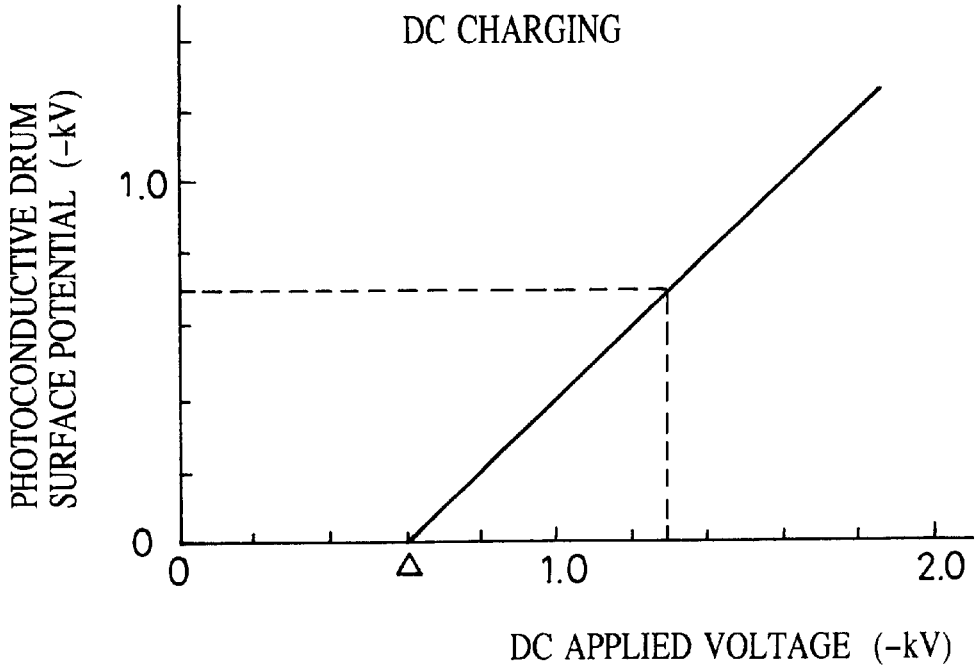
FIG. 4 is a graph showing a photoconductive drum surface potential with respect to an applied DC voltage during DC charging.

FIG. 4 graphically shows the relationship between an applied voltage and a charged potential in the DC charging method. In the DC charging, unlike the AC charging (FIG. 3), discharge is started when the applied voltage exceeds a discharge starting voltage, and the photoconductive drum surface can be charged by applying a voltage higher than the discharge starting voltage. Further, unlike the AC charging (FIG. 3), a DC setting value differs from an actual charged potential of the photoconductive drum surface. Accordingly, even when the target value of the charged potential is the same, a setting value for a high DC voltage differs between the full-color mode and the black unicolor mode. Because the relationship between the applied voltage and the charged potential at a voltage higher than the discharge starting voltage is linear with a gradient of 1, an applied high-voltage DC value can be set once the target value of the charged potential is determined. Assuming, for example, that the target value of the charged potential is—700 V, the surface of the photoconductive drum can be charged to the target value in this embodiment by applying a high DC voltage of—1300 V. (see FIG.4).

Figure 5A:
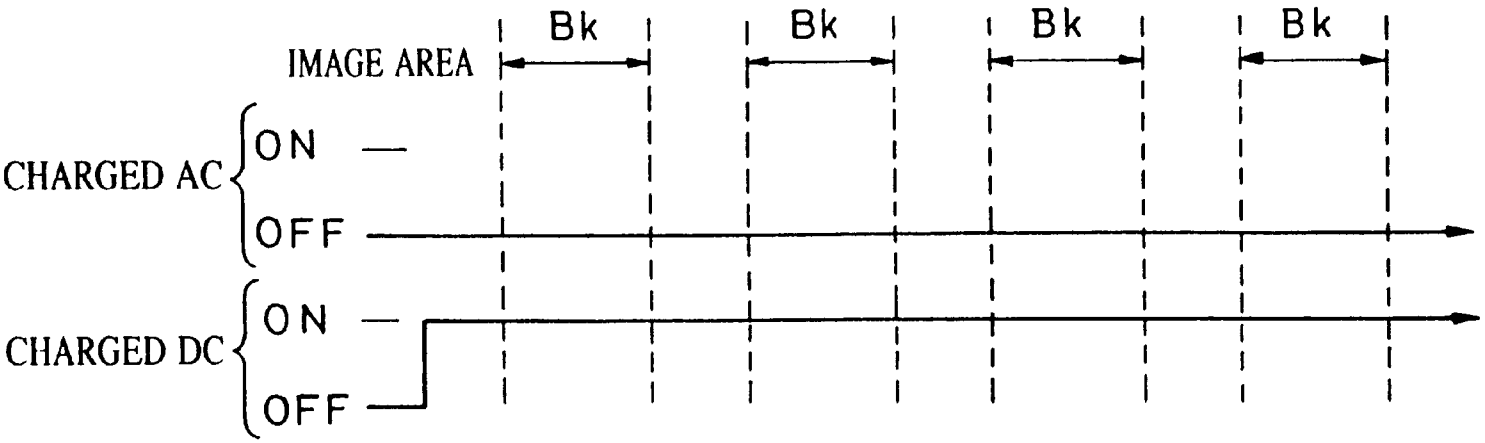
FIG. 5A is a time chart showing application of a charging bias (DC charging) in the black unicolor image forming mode.
Figure 5B:
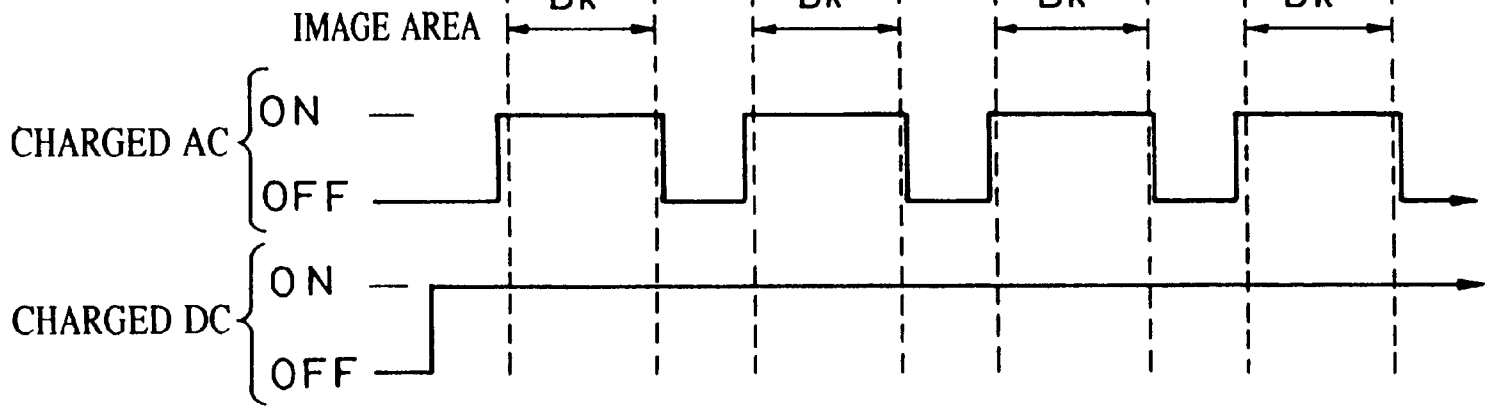
FIG. 5B PRIOR ART
FIG. 5B is a time chart showing application of a charging bias (AC charging) in the black unicolor image forming mode.

FIG. 5B shows a conventional black unicolor image forming mode in which a charging bias is applied with the AC charging. By contrast, FIG. 5A shows the black unicolor image forming mode in this embodiment in which an image is formed with the DC charging without applying any AC component.

Thus, in this embodiment, the photoconductive drum is charged with the DC charging in the black unicolor image forming mode without applying a high-voltage AC component that has been applied to the image forming position in the past.

By applying only a high-voltage DC component to charge the photoconductive drum in the black unicolor image forming mode for formation of an image, the useful life of the photoconductive drum-in the black unicolor image forming mode can be improved while ensuring good quality of a full-color image.

Specifically, the useful life of the photoconductive drum 1 was improved to such an extent that the number of sheets on which an image could be satisfactorily formed in the black unicolor image forming mode was increased from about 12000 to 14000.

While this embodiment has been described in connection with the case of forming a black unicolor image, a similar advantage can also be of course obtained in the case of forming a monochrome image of any other single color.

Changeover of the condition for applying an AC component of the charging bias between the case of selecting the full-color image forming mode and the case of selecting the black unicolor image forming mode is performed by controlling the charging bias applying power supply S in response to selection of the image forming mode with a control circuit (not shown) in the image forming apparatus.

Furthermore, this embodiment has been described in connection with the image forming apparatus in which the transfer material P is wound over the transfer drum 5, a toner image of each color is transferred onto the transfer material P successively, and a full-color image is formed by mixing of four colors. However, a similar advantage can also be obtained when the present invention is applied to an image forming apparatus of intermediate transfer type in which a toner image of each color is successively transferred from a photoconductive drum onto an intermediate transfer member, such as an intermediate transfer belt or an intermediate transfer drum, to form a full-color image thereon, and thereafter the full-color image is transferred together onto a transfer material.

Figure 6:
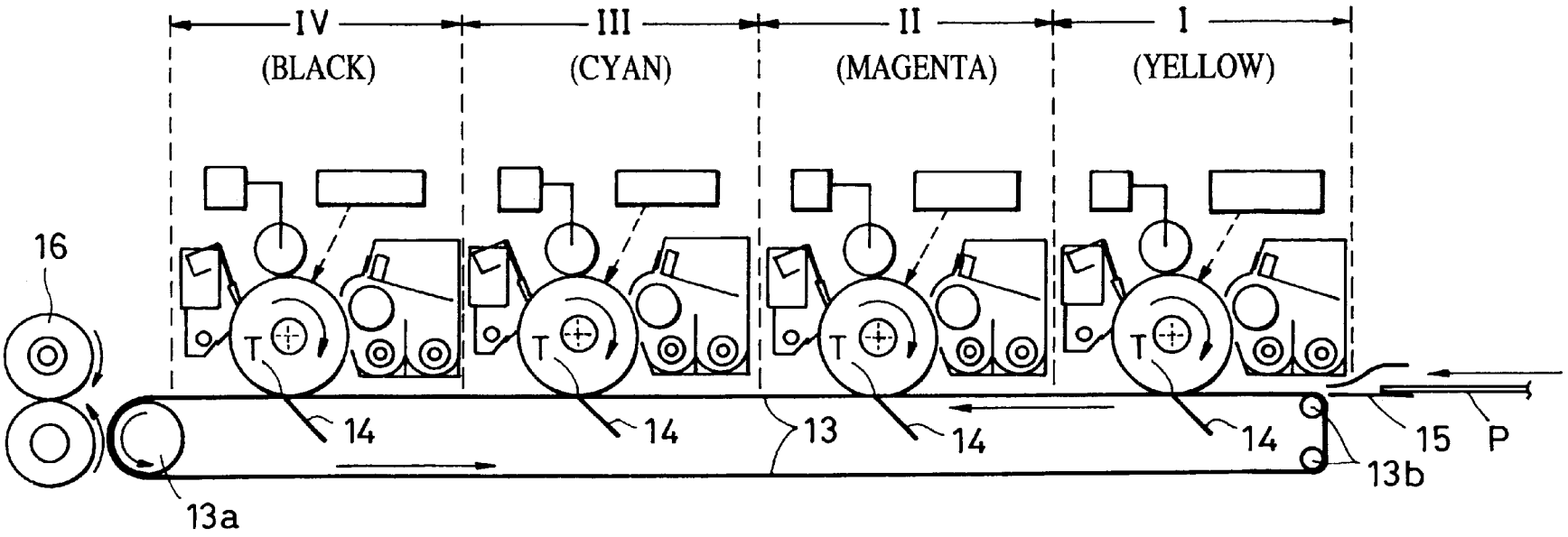
FIG. 6 is a schematic view showing the construction of an image forming apparatus according to second embodiment.
Figure 7:
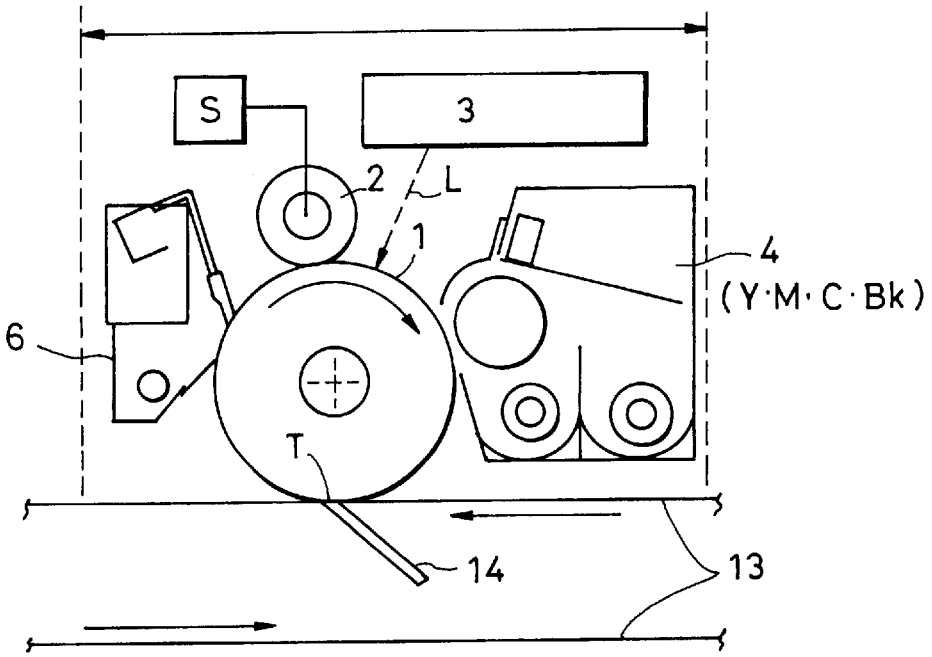
FIG. 7 is an enlarged view of one image forming station.

<Second Embodiment> (FIGS. 6 and 7)

An image forming apparatus of this second embodiment is constructed as a full-color image forming apparatus of tandem type including four first to fourth image forming stations I, II, III and IV which are arrayed from the right side to the left side in the order named.

(1) Outline of Overall Apparatus Construction

The first to fourth image forming stations I, II, III and IV are respectively mechanisms for forming a yellow toner image, a magenta toner image, a cyan toner image and a black toner image.

Each of the first to fourth image forming stations I, II, III and IV comprises a photoconductive drum 1 serving as an image carrier, a charging roller 2 serving as a contact charging member, a laser beam exposure device 3 serving as an image exposure means, a developing unit 4 and a cleaner 6. FIG. 7 is an enlarged view of one image forming station. Incidentally, the developing unit 4 of the first image forming station I is a yellow developing unit 4Y using a yellow toner as a developer; the developing unit 4 of the second image forming station II is a magenta developing unit 4M using a magenta toner as a developer; the developing unit 4 of the third image forming station III is a cyan developing unit 4C using a cyan toner as a developer; and the developing unit 4 of the fourth image forming station IV is a black developing unit 4 Bk using a black toner as a developer.

Numeral 13 denotes an endless transfer-material carrying belt disposed under the first to fourth image forming stations I, II, III and IV to extend substantially horizontally in the left-to-right direction while passing each image forming station successively. The belt 13 is stretched between a drive roller 13*a* on the left side and a drive roller 13*b* on the right side to move round both the rollers, and is driven to run and turn a counterclockwise as indicated by arrows at a speed almost the same as a circumferential speed of the rotating photoconductive drum 1.

Within the endless transfer-material carrying belt 13, there is a total of four transfer charging plates 14 disposed to form transfer nip portions T by bringing an upper running portion of the belt 13 into contact with respective lowermost surfaces of the photoconductive drums 1 in the first to fourth image forming stations I, II, III and IV under pressure.

Numeral 15 denotes a transfer material feed guide disposed at the right end of the endless transfer-material carrying belt 13.

Numeral 16 denotes a heat-roller fusing device disposed at the left end of the endless transfer-material carrying belt 13.

The image forming operation performed by each of the first to fourth image forming stations I, II, III and IV is basically the same. More specifically, in this embodiment, an outer circumferential surface of the photoconductive drum 1 driven to rotate at a predetermined circumferential speed clockwise as indicated by an arrow is uniformly charged by the charging roller 2 with negative electricity. After the charging, the laser beam exposure device 3 scans an optical image, as indicated by L, to a charged surface area of the rotating photoconductive drum 1 for exposure, thereby forming an electrostatic latent image corresponding to an image exposure pattern. The electrostatic latent image is then reversed-developed into a toner image by the developing unit 4. Stated otherwise, the toner in the developing unit 4 is charged with negative electricity, and a development electrical field is formed by both a voltage (developing bias) applied to a developing sleeve, which carries the toner and transports the toner to a development area near the photoconductive drum 1, a surface potential of the photoconductive drum 1. Under such a development electrical field, the toner is attached to the electrostatic latent image formed on the photoconductive drum 1 through reverse development, whereby the latent image is visualized as a toner image.

(2) Full-color Image Forming

When the full-color image forming mode is selected, the contact charging of the photoconductive drum 1 in each of the first to fourth image forming stations I, II, III and IV is carried out by the AC charging method to apply both an AC voltage component and a DC voltage component in superimposed relation for the purpose of increasing uniformity of the charging. Then, the following processes are performed.

① In the first image forming station I, the laser beam exposure device 3 exposes the charged surface area of the rotating photoconductive drum 1 with an optical image corresponding to a color-separated blue image of a color image, thereby forming an electrostatic latent image. The electrostatic latent image is developed into a yellow toner image by the yellow developing unit 4Y.

② In the second image forming station II, the laser beam exposure device 3 exposes the charged surface area of the rotating photoconductive drum 1 with an optical image corresponding to a color-separated green image of the color image, thereby forming an electrostatic latent image. The electrostatic latent image is developed into a magenta toner image by the magenta developing unit 4M.

③ In the third image forming station III, the laser beam exposure device 3 exposes the charged surface area of the rotating photoconductive drum 1 with an optical image corresponding to a color-separated red image of the color image, thereby forming an electrostatic latent image. The electrostatic latent image is developed into a cyan toner image by the cyan developing unit 4C.

④ In the fourth image forming station IV, the laser beam exposure device 3 exposes the charged surface area of the rotating photoconductive drum 1 with an optical image corresponding to a color-separated black image of the color image, thereby forming an electrostatic latent image. The electrostatic latent image is developed into a black toner image by the black developing unit 4Bk.

On the other hand, a transfer material P is supplied from a paper feed mechanism (not shown) and fed onto the endless transfer-material carrying belt 13 through the transfer material feed guide 15 at predetermined control timing. The transfer material P is then held on an upper surface of the belt 13, for example, under electrostatic attraction or with a chuck. With running of the belt 13, the transfer material P is transported to pass the transfer nip portion T of each of the first to fourth image forming stations I, II, III and IV successively. During the transport, a total of four toner images are transferred onto the transfer material P in a superimposed relation. Specifically, a yellow toner image is transferred in the transfer nip portion T of the first image forming station I; a magenta toner image is transferred in the transfer nip portion T of the second image forming station II; a cyan toner image is transferred in the transfer nip portion T of the third image forming station III; and a black toner image is transferred in the transfer nip portion T of the fourth image forming station IV. As a result, a full-color image is formed on the surface of the transfer material P by mixing the four colors.

The formation of the toner image in each of the first to fourth image forming stations I, II, III and IV is carried out in predetermined synchronous relation such that the toner images formed in the image forming stations are successively transferred onto the surface of the same transfer material P, which is transported with the belt 13, in an aligned and superimposed relation as designed in advance.

After being further transported with the belt 13 and passing the transfer nip portion T of the final fourth image forming station IV, the transfer material P is separated from the belt 13 and introduced to the heat-roller fusing device 16 where the toner images are fused under heating for permanent fixation. Thereafter, the transfer material P is ejected as a full-color image formed material into an ejection tray (not shown).

Further, in each of the first to fourth image forming stations I, II, III and IV, the toner remaining on the photoconductive drum 1 after the transfer of the toner image onto the transfer material P is removed by the cleaner 6, and the photoconductive drum 1 is ready for a next cycle of latent image formation.

(3) Black Unicolor Image Forming

When the black unicolor image forming mode is selected, the photoconductive drum 1 is driven for rotation in each of the first to third image forming stations I, II and III, but the operation of forming the toner image is not carried out in those stations. The operation of forming the toner image is carried out only in the fourth image forming station IV for forming the black toner image. In this case, the contact charging in the fourth image forming station IV is carried out by switching the charging method to the DC charging in which only a DC voltage is applied without applying an AC voltage.

The transfer material P transported with the belt 13 is not subjected to transfer of the toner images in the first to third image forming stations I, II and III, but subjected to transfer of the black toner images in the fourth image forming station IV. After passing the transfer nip portion T of the fourth image forming station IV, the transfer material P is separated from the belt 13 and introduced to the heat-roller fusing device 16 where the black toner image is fused under heating for permanent fixation. Thereafter, the transfer material P is ejected as a black unicolor image formed material into the ejection tray (not shown).

In an image forming apparatus having a plurality of image forming stations, if an AC component is added to a charging bias to be applied to a corresponding one of the image forming stations in the case of forming an image of single color, an abrasion of a surface layer of the photoconductive drum is progressed only in the corresponding image forming station. This phenomenon eventually may result in that the useful life of the image forming station is shortened which is more often operated to form an image of single color.

In the image forming apparatus of this embodiment, the full-color image forming mode is performed by additionally applying an AC component as a charging bias to charge an image forming surface area of the photoconductive drum in each image forming station for the purpose of ensuring uniformity of the charging.

When an image of single color, e.g., black, is formed by using one image forming station, the photoconductive drum is charged only with a DC component for image formation without adding an AC component to a charging bias as with the above first embodiment. As a result, even in the image forming station which is more often operated to form an image of a single color, the useful life of the photoconductive drum can be made comparable to that of the photoconductive drums in the other image forming stations.

While this embodiment has been described in connection with the case of forming a black unicolor image, a similar advantage can also be of course obtained in the case of forming a monochrome image of any other single color.

Furthermore, this embodiment has been described in connection with the full-color image forming apparatus in which the transfer material P is held on the transfer material carrying belt 13 and a toner image of each color is transferred onto the transfer material P successively. However, a similar advantage can also be obtained when the present invention is applied to an image forming apparatus of an intermediate transfer type in which a toner image of each color is successively transferred from a photoconductive drum onto an intermediate transfer member, such as an intermediate transfer belt or an intermediate transfer drum, and thereafter the full-color image is transferred together onto a transfer material.

Although the above invention has been described with preferred components and elements, the components and elements may be changed or substituted with different components and elements but still within the desired scope of the present invention. In this regard, the image exposure means for forming an electrostatic latent image on the photoconductive drum is not limited to the laser beam exposure device, but may comprise any other suitable means, such as another digital image exposure device, e.g., an LED array, and an analog image exposure device, so long as it is able to effect image exposure corresponding to image information.

The image carrier may be formed of a dielectric for bearing an electrostatic latent image, or the like. In this case, after uniformly charging the surface of the dielectric into a predetermined polarity and potential, an electrostatic latent image is written and formed by selectively removing the charged electricity by a charge eliminating means such as a charge eliminating needle head or an electron gun.

The AC voltage applied to add an AC voltage component (vibrating voltage or alternating voltage) in a charging bias or a developing bias may have any suitable waveform such as a sinusoidal, rectangular and triangular waveform. A rectangular wave may be produced by cyclically turning on/off an AC power supply. Thus, any suitable bias having a voltage value changed cyclically can be used as a wave applied as the AC voltage component.

There is an image display device (e.g., a display and a electronic copyboard) wherein a toner image corresponding to desired image information is formed and borne on an image carrier such as an endless belt, an area in which the toner image has been formed is positioned in a read/display portion to display a visual image, and after the display the toner image is removed and the image carrier is employed again for formation of a next display image. The image forming apparatus of the present invention includes such an image display device as well.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

an image carrier for carrying an electrostatic latent image;

a charging member contacting said image carrier and charging said image carrier with electricity;

voltage applying means for applying a voltage to said charging member;

selecting means for selecting one of a monochrome mode for forming an image in a single color and a full-color mode for forming an image in multiple colors; and changing means for changing a voltage applied from said voltage applying means to said charging member between the monochrome mode and the full-color mode.

2. An image forming apparatus according to claim 1, wherein said voltage applying means is able to apply a DC voltage and an AC voltage, and said changing means changes a condition for applying the AC voltage.

3. An image forming apparatus according to claim 2, wherein said changing means changes a voltage such that a DC voltage is applied to said charging member in the monochrome mode and a voltage including DC and AC components in superimposed relation is applied to said charging member in the full-color mode.

4. An image forming apparatus according to claim 1, further comprising a yellow developing unit containing a yellow toner, a cyan developing unit containing a cyan toner, a magenta developing unit containing a magenta toner, and a black developing unit containing a black toner.

5. An image forming apparatus according to claim 4, further comprising four image carriers corresponding to said developing units of four colors in one-to-one relation.

* * * * *